114-242 MECH 3R
4/5/83 XR 4,378,750

United States Patent [19]
Holzhauer

[11] 4,378,750
[45] Apr. 5, 1983

[54] WATER SKI TOW HARNESS FLOAT

[75] Inventor: Henry J. Holzhauer, Spirit Lake, Iowa

[73] Assignee: Berkley and Company, Inc., Spirit Lake, Iowa

[21] Appl. No.: 270,096

[22] Filed: Jun. 3, 1981

[51] Int. Cl.[3] ..... B63B 21/56
[52] U.S. Cl. ..... 114/249; 114/253; 114/242; 441/68
[58] Field of Search ..... 280/480; 114/249, 242, 114/253, 254; 441/68, 69, 73; 244/1 TD; 254/401-403, 405, 409-415, 390; 294/78 A, 78 R

[56] References Cited

U.S. PATENT DOCUMENTS

| | | | |
|---|---|---|---|
| 1,621,168 | 3/1927 | Kluver . | |
| 1,724,913 | 8/1929 | Davis | 254/413 |
| 2,395,892 | 3/1946 | Lontz | 9/8 |
| 2,453,857 | 11/1948 | Platt et al. | 244/17 |
| 2,477,569 | 8/1949 | Beirise | 280/33 |
| 2,816,310 | 12/1957 | Nale | 9/21 |
| 2,872,889 | 2/1959 | Johnson | 114/235 |
| 2,943,591 | 7/1960 | Schneider | 114/235 |
| 3,294,053 | 12/1966 | Emery, Jr. | 114/249 |
| 3,606,981 | 9/1971 | Daniels | 254/415 |
| 4,213,413 | 7/1980 | Courtney | 114/253 |

FOREIGN PATENT DOCUMENTS

| | | | |
|---|---|---|---|
| 609860 | 9/1958 | Canada | 114/235 |

OTHER PUBLICATIONS

Puritan, Water Ski Tow Harnesses, Product R7501, Catalog sheet p. 16, date unknown.

*Primary Examiner*—Trygve M. Blix
*Assistant Examiner*—C. T. Bartz
*Attorney, Agent, or Firm*—Schroeder, Siegfried, Vidas, Steffey & Arrett

[57] ABSTRACT

A tubular float for use in a water ski tow device. The float has a hollow shaft pulley in one end thereof and a slot in the other end thereof. A hitch rope is attached to the transom of the boat at locations displaced from the central axis of the boat. The hitch rope is roved through the pulley. A tow rope is inserted through the slot and passed along the tubular body of the float through the hollow shaft of the pulley back along the hollow body of the float through the slot from an opposite direction and then tied or spliced to the main length of the tow rope to form a tow structure not susceptible to failure in the event of structural damage to the float.

2 Claims, 4 Drawing Figures

WATER SKI TOW HARNESS FLOAT

DESCRIPTION

BACKGROUND OF THE INVENTION

This invention relates to a float for a towing device for a motor boat adapted for use in towing skiers, or the like.

Johnson U.S. Pat. No. 2,872,889 shows a water ski tow device utilizing a solid tow bar connected to two points on the transom of the boat and utilizing a pulley mounted on the tow bar as a tie point to a tow rope. For a number of reasons, such a device does not provide a particularly useful solution to the problem of connecting a water ski tow rope to a power boat.

Schneider U.S. Pat. No. 2,943,591 provided improvement over Johnson by including a float between the pulley and tow rope and in substituting a flexible hitch rope connected to the boat transom for a solid tow bar shown in Johnson.

The structure shown in Schneider is relatively difficult to manufacture and its installation and use may result in inordinate wear on the tow rope because of the sharp bend placed in the rope as it passes through the eye of the pulley structure.

SUMMARY OF THE INVENTION

In accordance with the invention, there is provided a water ski tow apparatus utilizing a tubular float portion having an integral pulley wheel mounted on one end thereof and a slot in the other end thereof, the float device being adapted to receive the end of said tow rope through the slot. The rope is passed along one side of the tubular float structure through a hollow shaft through the axis of the pulley and back along the other side of the float and through the slot from the opposite direction for attachment to the main part of the tow rope.

By use of my device, an easily manufactured and safe tow device is provided.

DETAILED DESCRIPTION OF THE INVENTION

Figure 1:
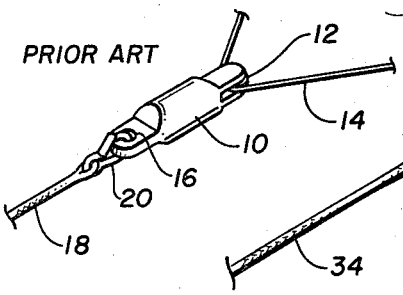
FIG. 1 is a pictorial view showing a prior art float device.

In FIG. 1 there is shown a prior art commerically available tow line float 10 which includes a pulley 12 roved on a hitch line 14 attached at two locations on opposite sides of the transom of a conventional power boat. The float 10 is molded and includes a hole 16 at the end opposite the end carrying the pulley. The float is shown attached to a tow line 18 by a hook 20. In use, a problem would exist with such a prior art device in the event of a structural failure of the float 10. In the event of a failure of the structure 10, disconnection between the tow rope 18 and the boat would occur rapidly, possibly causing injury. Also, use of the hook 20 to attach the end of tow line 18 to the float 10 is also a source of potential failures of the float 10 because of the point forces applied by the metal hook against the plastic or nylon body of float 10.

Figure 2:
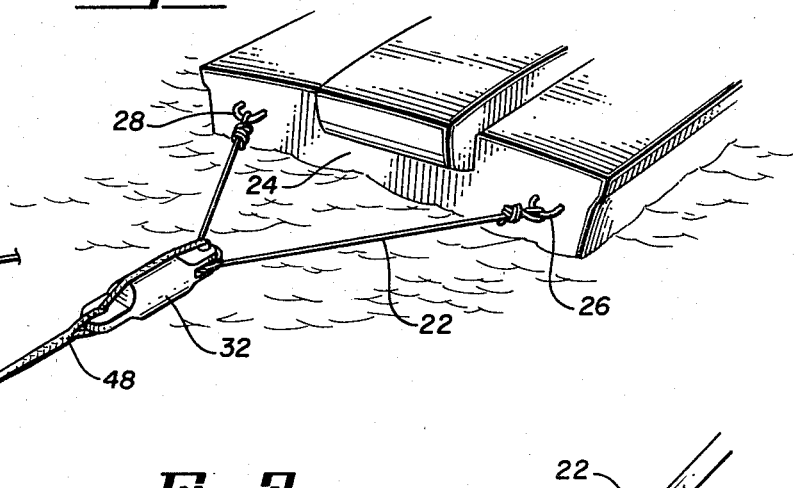
FIG. 2 is a pictorial view showing a float device according to my invention connected to a boat transom.
Figure 3:
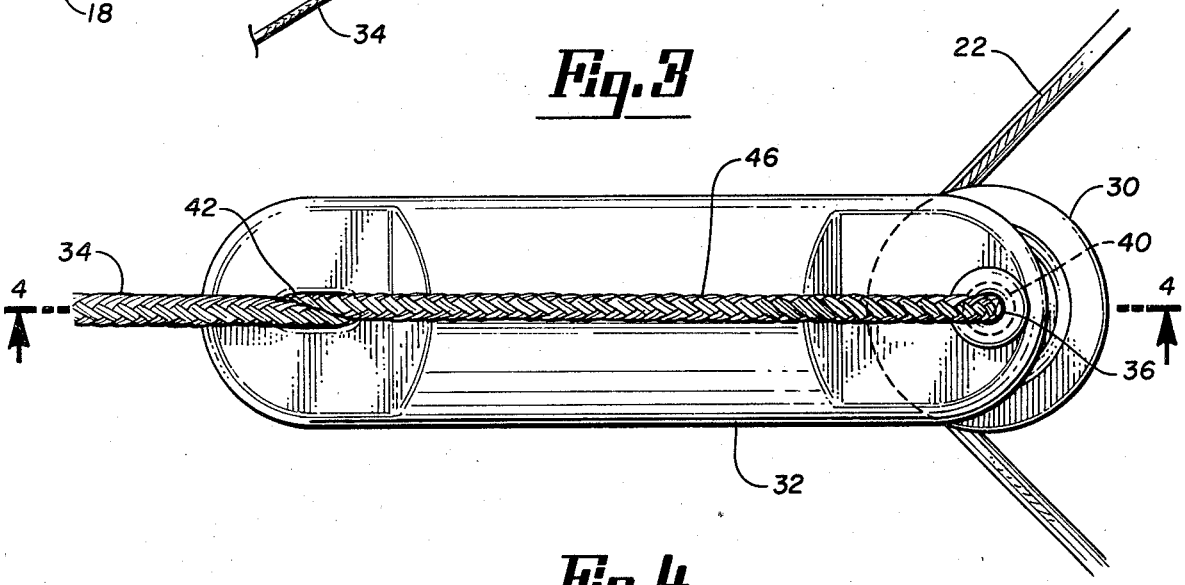
FIG. 3 is as top plan view of the device.
Figure 4:
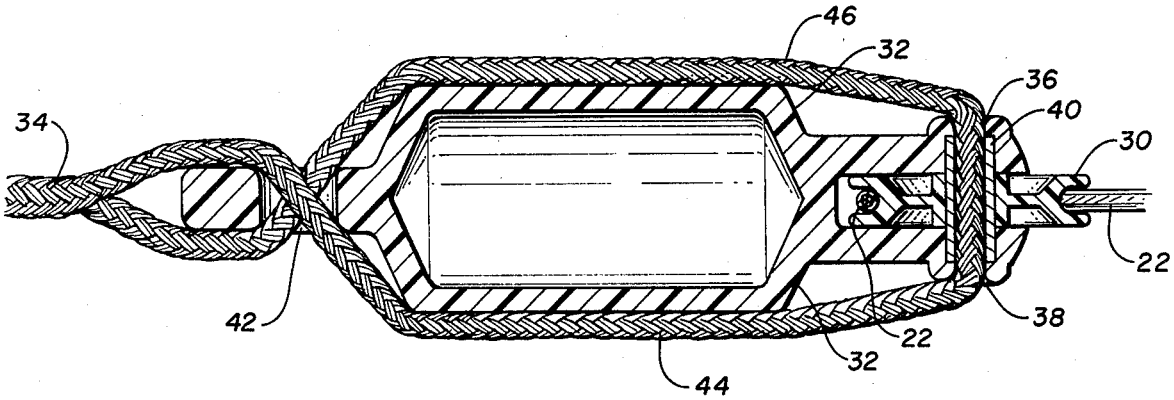
FIG. 4 is a vertical cross-section of the invention taken along the line 4—4 of FIG. 3.

In order to overcome the potential difficulties found with such prior art structures, I have developed the improved float structure shown in FIGS. 2 through 4.

In FIG. 2, the hitch line 22 is shown attached to the transom 24 of a power boat at cleats or eyes 26 and 28. The hitch line, rope or cable 22 is roved through a pulley 30. The length of the hitch rope 22 is sufficient to allow the float unit 32 to ride well behind the boat and propeller as the boat is towing a water skier or other object utilizing tow line 34.

The float 32 includes apertures 36 and 38 which communicate to the interior of the float and a cylindrical bushing 40 which serves as the axle for pulley 30. The prior art float structure shown in FIG. 1 utilizes a solid, metal pulley shaft.

In order to provide a reliable and safe tow structure, the tow rope 34 is threaded through a slot 42 at the opposite end of the float 32 from pulley 30 and a segment 44 of the tow rope 34 passes along one side of the float body 32 through the aperture 38, bushing 40 out aperture 36 and a portion 46 of the rope then passes along the other side of the body of the float 32 and through the slot or opening 42 in the other end of the float in a direction opposite to that followed by segment 44. Splice 48, as shown in the Figures, or a conventional knot is used to attach the end of rope to the main portion 34.

The dimensions of slot 42 are selected to be sufficiently narrow to prevent a rope hook from being inserted therein. Avoidance of the use of the hook with the float avoids the point stresses which could cause failure of a float manufactured from a plastic material.

Routing the tow rope through the slot and pulley and along both sides of the pulley structure forms a more reliable structure since the load forces between the tow rope 34 and the hitch rope 22 are borne by two pieces of tow rope 44 and 46 as well as the float structure 32. Accordingly, no disconnection of the tow rope from the hitch line will occur in the event of a structural failure in the float 32. Because the float is not subjected to the towing forces, the likelihood of any structural failure of the float 32 is considerably diminished over that possible in the prior art system.

What is claimed is:

1. In combination with a motor powered boat, a tow line harness comprising:

a tubular float, said float having a slot at one end thereof and a pulley mounted at the other end thereof, with said pulley having a rope receiving passageway therethrough;

a hitch rope roved through said pulley for attachment at both ends to the transom of said boat to form a V with the pulley located at the apex thereof and a tow rope, one end of which is passed through said slot around said float through the rope receiving passageway of said pulley, back along said float and through said slot in an opposite direction and secured to the remainder of said tow rope.

2. A float for use in a tow line harness which includes a tow rope and a hitch rope connected at both ends to the transom of a boat, said float comprising a central body portion and first and second end portions, said first end portion having a pulley mounted therein, said pulley constructed and arranged to receive said hitch rope roved therethrough, said first end portion also having a hollow passage for receiving the end of said tow rope therethrough and said hollow passage coaxial with said pulley, said second end portion having a slot therein for receiving the end of said tow rope threaded therethrough from one side and from the other side after the tow rope is passed around said float and through said hollow passage through said first end of the float and the pulley and back along said float.

* * * * *